US007121432B2

(12) United States Patent
Kostal et al.

(10) Patent No.: US 7,121,432 B2
(45) Date of Patent: Oct. 17, 2006

(54) CONTROL UNIT FOR A LIGHT SOURCE IN COMBINATION WITH A SPRAY DEFENSE CONTAINER

(76) Inventors: Bretislav Kostal, Zelivecka 12, 15000 Prague 10 (CZ); Vladimir Kupa, Frant. Sramka 15, 15000 Prague 5 (CZ)

( * ) Notice: Subject to any disclaimer, the term of this patent is extended or adjusted under 35 U.S.C. 154(b) by 217 days.

(21) Appl. No.: 10/823,821

(22) Filed: Apr. 14, 2004

(65) Prior Publication Data

US 2005/0092773 A1 May 5, 2005

(30) Foreign Application Priority Data

Nov. 4, 2003 (CZ) ..... 2003-2987

(51) Int. Cl.
*B67D 1/07* (2006.01)
*B65D 5/66* (2006.01)
*F21V 33/00* (2006.01)

(52) U.S. Cl. ..... 222/192; 222/113; 222/182; 222/183; 362/96; 362/101; 362/113; 362/253

(58) Field of Classification Search ..... 222/192, 222/182, 183, 175, 105, 113, 402.1, 402.13, 222/402.23; 362/96, 205, 208, 101, 113
See application file for complete search history.

(56) References Cited

U.S. PATENT DOCUMENTS 3,794,791 A * 2/1974 Thomson ..... 200/61.93
4,079,862 A * 3/1978 Fegley ..... 222/162
5,086,377 A 2/1992 Roberts
5,373,427 A 12/1994 McLean
5,549,220 A 8/1996 Whalen
5,875,945 A * 3/1999 Roach ..... 224/217
6,439,432 B1 * 8/2002 Park ..... 222/113
6,676,270 B1 * 1/2004 Kostal et al. ..... 362/96

FOREIGN PATENT DOCUMENTS

EP 02011133.2 5/2002

* cited by examiner

*Primary Examiner*—Kevin Shaver
*Assistant Examiner*—Stephanie E. Tyler
(74) *Attorney, Agent, or Firm*—Collard & Roe, P.C.

(57) ABSTRACT

A control unit in combination with a conventional self-defense spray container represents a combined light emitting and spray discharging self-defense device. The unit comprises a housing for a light source having a lower prismatic portion, a sleeve for securing the housing to a self-defense spray container and a cover coupled with the housing and having a free portion to support a battery source. The unit further comprises means for rotational mounting the cover on the housing at the coupling portion of the cover, an electrical circuit for connecting the battery source to the light source and a switch associated with said housing and said cover for closing and opening said electrical circuit.

11 Claims, 4 Drawing Sheets

CONTROL UNIT FOR A LIGHT SOURCE IN COMBINATION WITH A SPRAY DEFENSE CONTAINER

FIELD OF THE INVENTION

This invention relates to a control unit for a light source in combination with a spray defense container and may be used by law enforcement forces and general public for self-defense actions whereby the flashlight of the light portion should help the intended victim to allocate the assailant's face and/or to partially blind and deter him and subsequently or at the same time the defending spray can be applied against the assailant's eyes if the assailant continues in his action against the victim.

DESCRIPTION OF THE PRIOR ART

There are many types of combined devices known in the art. Most of them are based on a conventional concept of a torch or battery lamp, in certain cases also in combination with a baton, adapted to form an assembly including a self-defense spray container. As disclosed in the U.S. Pat. No. 5,086,377 such a device may consist of a middle portion comprising a defending spray and an end portion with a light and sound alarm devices. Such as a device is big in size and therefore not suitable to be carried in a handbag or pocket.

From the U.S. Pat. No. 5,549,220 a pistol-shape device is known that includes in a housing a storage battery, two lamps emitting blue and white light respectively, a sound source and a chemical repellent container. The device includes at least three separate compartments, internal wiring and piping to provide the respective connections between the operating switches, battery, lamps and a gas nozzle. The device is operated by two switches and a trigger what may be rather confusing in the situation when it should be used against an unexpected assailants and therefore very quickly and with an immediate and surprising effect. Moreover, due to its considerable size such device is not suitable to be carried in a handbag specifically in a ladies shoulder bag or a clutch bag or a pocket.

U.S. Pat. No. 5,373,427 discloses a device having a shape of a conventional elongated torch housing serving as a holder with a lamp emitting light substantially in a right angle to the torch holder and disposed at the upper end thereof. A self-defense spray container is inserted in the housing below the lamp and the lower interior part of the housing is occupied by a battery pack. The access to the spray activating button on the container is covered by a rotational cover, which when lifted in its upper position operates as a switch connecting the terminals of the lamp and batteries to activate the emission of light. In the lower closed position the cover surface is leaning towards the vertically biased exterior portion of the housing and closes the opening providing otherwise the access to the spray actuating button. In use by the defender the cover must be first allocated then gripped by a finger and lifted. The time necessary for taking such actions may be critical one in view of the condition of a victim exposed to a sudden or unexpected assailant's attack. Moreover, the design where the lamp is separated from batteries by a spray container requires rather complicated connection between the lamp, battery and switch and relatively big dimensions like with the above described devices.

The EPA pat. application No. 02011133.2 discloses a combined self-defense device comprising a light portion and a spray portion mutually connected by a specially designed flange to form a single unit and enable activation of both the light source and the container button. The light source is a LED diode and the accumulator is a button-type battery. This design provides for a considerably reduced size of the device and for a variability of mutual arrangement of all its components. One of the possible alternatives includes a successive actuation of the light source and the spray container by one single actuating button. Nevertheless, the spray container button is not sufficiently protected from unwilling depression and the adaptation to various defense spray containers may be rather complicated.

SUMMARY OF THE INVENTION

The primary object of the invention is a control unit for a light source that in combination with a spray defense container enables to minimize the size of the device and to provide simple adaptation thereof to a conventional spray container.

Another object of the invention is to equip such device with means preventing an improper activating of its both functions.

Still another object of the invention is to enable easy and quick operation of both the light source and the spray portion.

According to one aspect of the invention the control unit for a light source in combination with a spray-defense container provided with actuating button and nozzle comprises a housing portion including a light source located in its upper part and an opening for the container nozzle in its lower part, a sleeve portion including an upper part for receiving said housing and a lower part for association with the container, a cover including a coupling end and a free end and an internal compartment for supporting a battery source, means for rotational mounting the cover on the housing at the coupling end, circuit means for electrically connecting the battery source to the light source, switch means associated with said housing and said cover for closing and opening said circuit means.

According to another aspects of the invention the upper part of the sleeve is provided with a recess for receiving the lower portion of the housing and with a passage opposed to said recess for access to the container button. The lower part of the sleeve is provided with a flange for attachment to the container or has the form of a case for receiving the container.

Still another aspect of the invention includes the arrangement where the cover is in its closed position situated in the plane substantially perpendicular to the longitudinal axis of the container and its free end is biased against the passage in the sleeve.

To enable the light source to be actuated by lifting the cover, the light source is provided by a first and second feeding lead fixedly mounted in the housing and the cover is mounted for rotation motion on the housing by means of a hollow shaft comprising two inside springs for urging the cover against said passage in the sleeve and having outer and inner terminals extending from the hollow shaft whereby a first outer terminal forms a fixed contact to the first light source feeding lead and the second outer terminal forms a movable contact to the second light source feeding lead and the inner terminals serves as fixed contacts to the battery source. The housing portion and the sleeve portion may be integrated in one body and advantageously the light source is a light emitting diode and the battery source is a button-type battery.

BRIEF DESCRIPTION OF THE DRAWINGS

Further objects of the present invention together with additional features contributing thereto will be apparent from preferred embodiments of the invention as illustrated in the accompanying drawings wherein.

DETAILED DESCRIPTION OF THE PREFERRED EMBODIMENT

Figure 1:
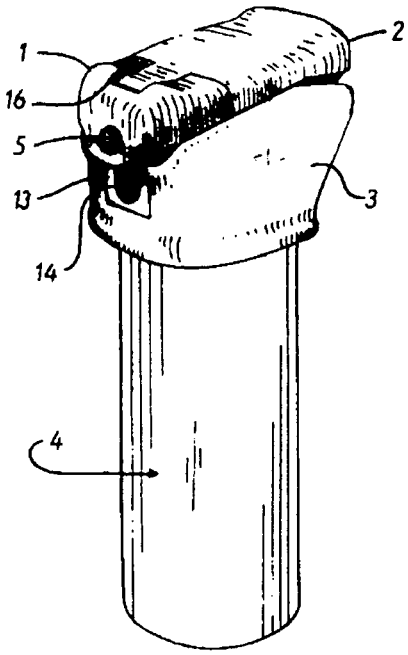
FIG. 1—is a perspective view of a control unit
Figure 2:
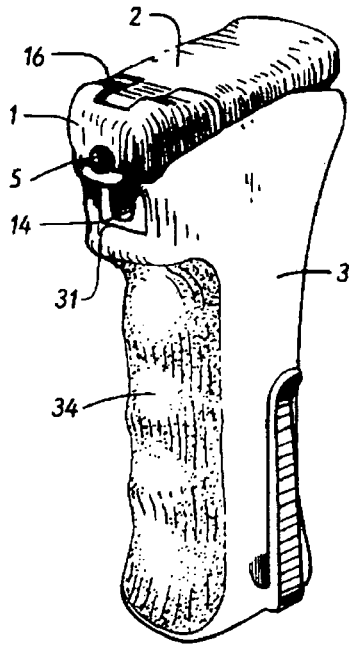
FIG. 2—is a perspective view of a control unit with a sleeve in the form of a case for receiving a container.
Figure 3:
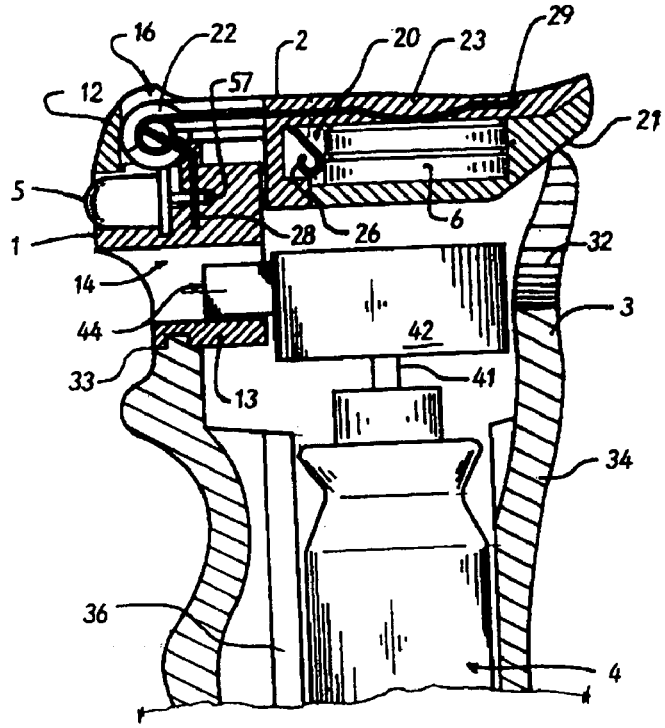
FIG. 3—is a front sectional view of the control unit shown in FIG. 2.
Figure 4:
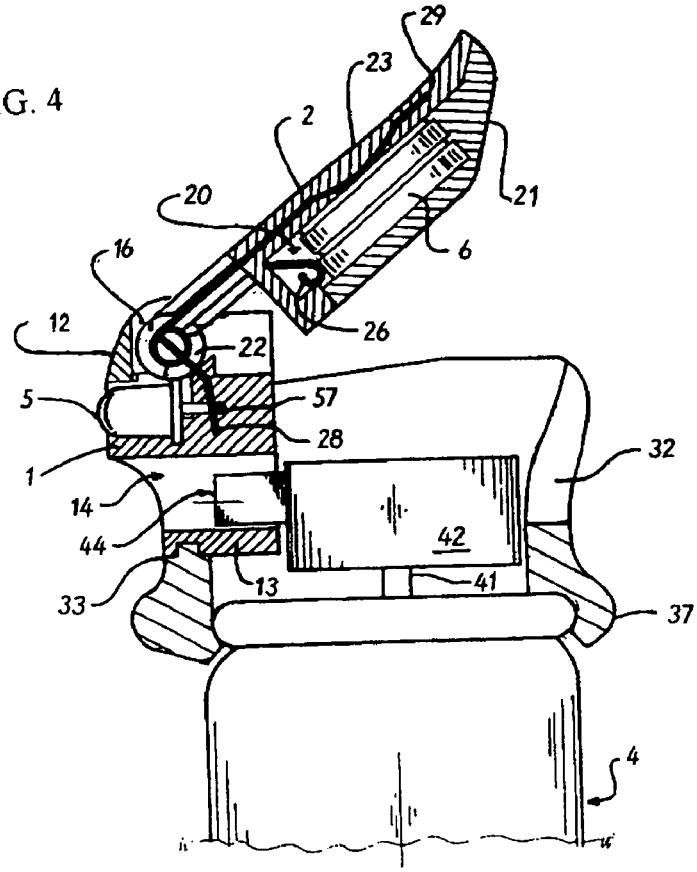
FIG. 4—is a front sectional view of the control unit shown in FIG. 1.

With respect to embodiments shown in FIG. 3 or 4 a control unit according to the invention comprises a housing 1 for a light source 5 having a lower prismatic portion 13 as shown in perspective view in FIG. 1 and FIG. 2, a sleeve 3 to secure the housing 1 to a self-defense spray container 4 and a cover 2 with a front coupling end and a free end 23 supporting a battery source 6. In combination with a conventional self-defense spray container the control unit represents a combined light emitting and spray discharging self-defense device.

The cover 2 is by its coupling end mounted for rotational motion on the housing 1 while the free end 23 thereof includes an interior compartment 20 for supporting the battery source 6, which is in the present embodiment represented by a button-type batteries pack. The compartment 20 is closed by a cap 21.

The sleeve 3 has a recess 31 in its front wall and an opposite situated passage 32 in its back wall. The recess 31 is designed as a mount base 33 for securing the lower prismatic portion of the housing 1 to the sleeve 3. In the embodiment shown in FIG. 2 and FIG. 3 the sleeve 3 extends downwardly to form a case 34 for storing the container 4. The container 4 is of a conventional shape and structure with an upper rim, an internal valve, outlet tube 41 and an actuating button 42 ending with an outlet nozzle 44. The case 34 serves also as a hand-held portion of the control unit and is provided by internal ribs 36 to secure a proper position of the container 4 in the case 34. In the embodiment of FIG. 1 and FIG. 4 the lower end of the sleeve 3 is terminated by a flange 37 for fixing the sleeve 3 on the rim of the container 4.

The housing 4 includes in its upper portion ridges 12 and a hollow shaft 22 extending through a rectangular recess 16 and rotatably mounted in the ridges 12 providing thus a hinge for the cover 2. To enable the discharge of the spray along the light beam the lower prismatic portion of the housing has an opening 14 for the nozzle 44. The light source 5 is in the present embodiment a light emitting diode (LED). The light source is further provided by a first feeding lead 55 and a second feeding lead 57 both fixed in the housing 1.

Figure 5:
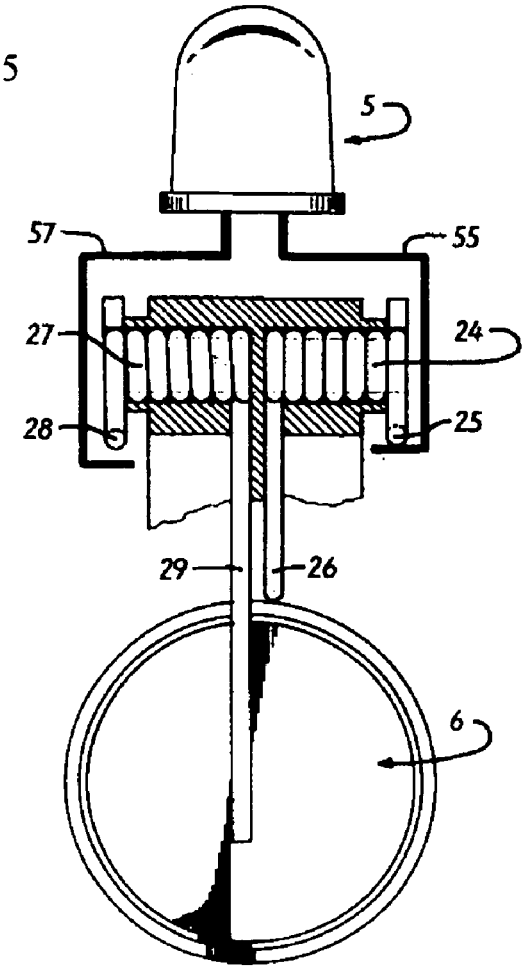
FIG. 5—is an exploded detailed view of an electric circuit of a light source and a battery source.

The free end 23 of the cover 2 is biased against the upwardly projecting edges of the passing 32 in the sleeve 3 by inner terminals 26, 29 of two coil springs 24, 27 placed in the hollow shaft 22. The inner terminals 26, 29 of the springs 24, 27 are fixed in the free end 23 of the cover 2 to serve also as stable contacts to the batteries 6 as illustrated in detail in FIG. 5. The outer terminals 25, 28 of the coil springs 24 27 consist of a first outer terminal 25 of the spring 24 which is embedded in the housing 1 and a second outer terminal 28 of the spring 27 serving as a movable contact cooperating with the second feeding lead 57 of the light source 5 to close or open the feeding circuit electrically connecting the batteries 6 with the light source 5.

In FIG. 4 the cover 2 is illustrated in its open condition, in which the movable contact of the second outer terminal 28 of the spring 27 engages the second feeding lead 57 of the light source 5 to close the feeding circuit and activate the light source 5.

Figure 6:
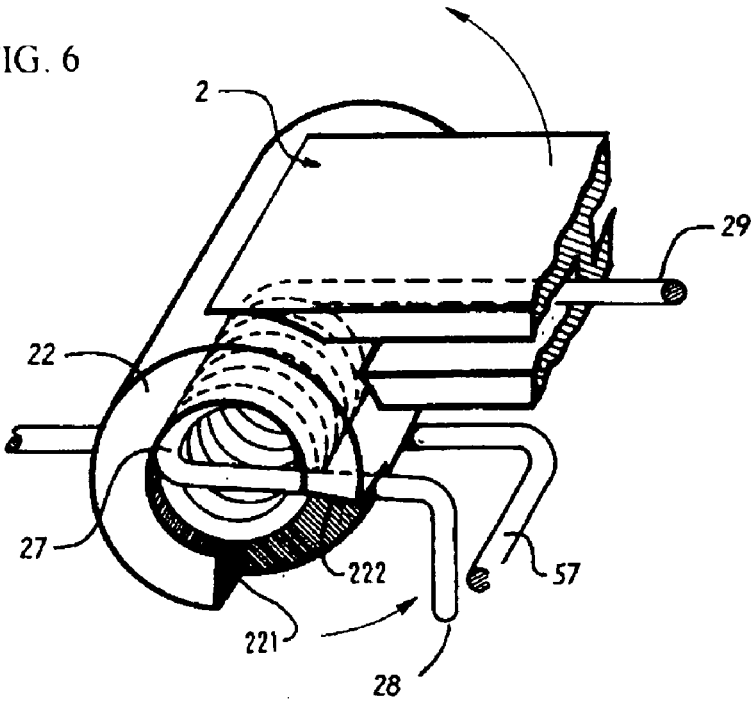
FIG. 6—is a exploded detailed view of the structure of contacts for actuating the electric circuit.

A detailed arrangement and function of the movable contact and the second feeding lead 57 appears from FIG. 6. The hollow shaft 2 is provided at its one end with a cut-out 221 having an upper face 222 and a lower face 221. The movable contact—the second outer terminal 28 is urged by the force of the coil spring 27 against the upper face 222. Upon lifting the cover 2 towards its opened condition in the direction of arrow the second outer terminal 28 engages the second feeding lead 57 while the upper face 222 of the cut-out disengages the second outer terminal 28. The motion of the cover 2 upwardly is interrupted when the lower face 221 abuts the second outer terminal 28.

The device may be operated by one finger. By inserting the finger in the passage 32 in the sleeve 3 the cover 2 is moved into its upper condition as shown in FIG. 4 and simultaneously the access to the button 42 of the container 4 with the self-defense spray is enabled. The electrical circuit is automatically closed and the light source activated as described above. By depressing the button the container valve is released and the spray discharged through the nozzle 44 in the direction of the light beam generated by the light source 5.

Figure 7:
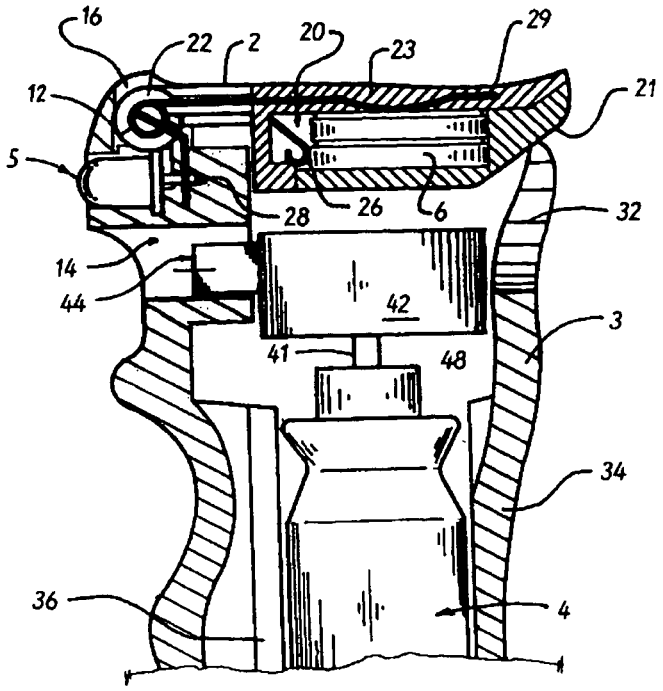
FIG. 7—is a front sectional view of the unit shown in FIG. 2 with certain elements integrated in one body.
Figure 8:
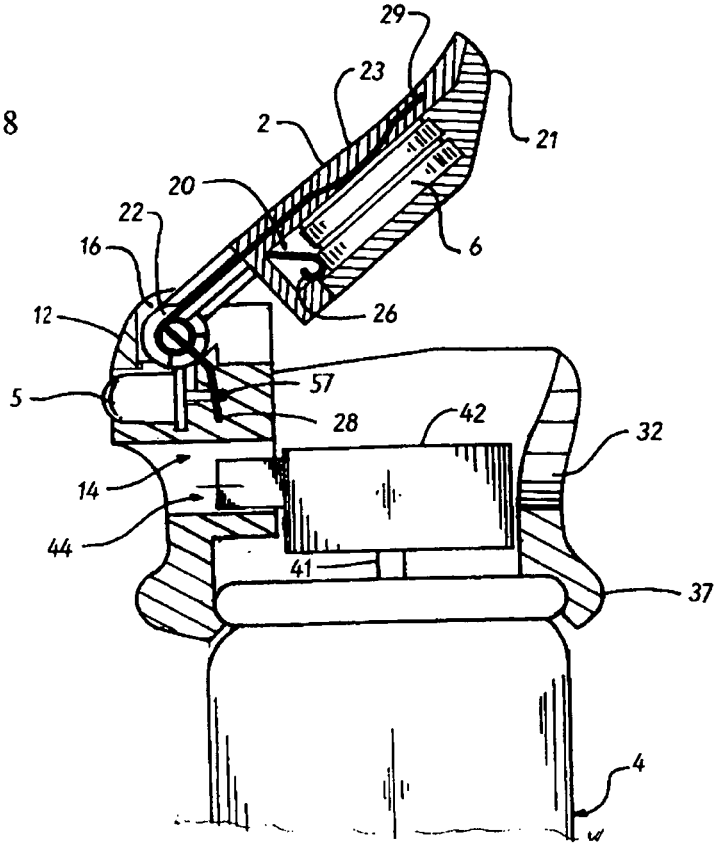
FIG. 8—is a front sectional view of the unit shown in FIG. 1 with certain elements integrated in one body.

FIG. 7 and FIG. 8 illustrate other embodiments of the invention where a housing 1 and a sleeve 3 are integrated into one single body. Except this feature the structure and function of other elements of the control unit according to the invention are the same as in the previous described embodiments and they need not be further described. Accordingly the same reference number are used for the corresponding elements.

INDUSTRIAL APPLICABILITY

The control unit according to the invention may be used as a non-destructive self-defense device that due to its minor size and easy operation is available not only to the law enforcement personnel by also to the general public.

The invention claimed is:

1. A control unit for a light source in combination with a spray-defense container provided with an actuating button and a nozzle comprising:

a housing portion including a light source and an opening for the container nozzle;

a sleeve portion including an upper part for receiving said housing and a lower part for association with the container;

a cover extending over the actuating button having a coupling portion and a free portion with an internal compartment for supporting a battery source;

means for rotational mounting of the cover at its coupling portion on the housing to enable the cover to rotate from its closed position in plane substantially perpendicular to the longitudinal axis of the container to its opened position enabling a free access to the actuating button;

circuit means for electrically connecting the battery source to the light source; and switch means associated with said housing and said cover for closing said circuit means in the opened position of the cover and for opening said circuit means in the closed position of the cover.

2. The control unit according to claim 1 wherein the upper part of the sleeve is provided with a recess for receiving the housing and with a passage opposed to said recess for access to said actuating button.

3. The control unit according to claim 1 wherein the lower part of the sleeve is provided with a flange for attachment to the container.

4. The control unit according to claim 1 wherein the sleeve has the form of a case for receiving the container.

5. The control unit according to claim 1 wherein the free end of the cover is biased against the sleeve.

6. The control unit according to claim 1 wherein the housing has an upper part for receiving said light source and a lower part provided with said opening for the container nozzle and further having a front side including an aperture for the light source in the upper part and said opening in the lower part and a back side wherein the free portion of the cover and extends partially into the passage in the sleeve to occupy the space behind the back side of the housing.

7. The control unit according to claim 1 wherein the light source is provided by a first and second feeding lead fixedly mounted in the housing and the cover is mounted for rotatable motion on the housing by means of a hollow shaft including two inside springs for urging the cover against said passage in the sleeve and having outer and inner terminals extending from the hollow shaft whereby a first outer terminal forms a fixed contact to the first light source feeding lead and the second outer terminal forms a movable contact to the second light source feeding lead and the inner terminals form fixed contacts to the battery source.

8. The control unit according to claim 1 wherein the housing portion and the sleeve portion are integrated in one body.

9. The control unit according to claim 1 wherein the light source is a light emitting diode and the battery source is a button-type battery.

10. The control unit for a light source in combination with a spray-defense container provided with an actuating button and a nozzle comprising:

a housing portion including a light source located in its upper part and an opening for the container nozzle in its lower part;

a sleeve portion including an upper part for receiving said housing and a lower part for association with the container; a cover having a coupling portion and a free portion and an internal compartment for supporting a battery source and being situated in a plane substantially perpendicular to the longitudinal axis of the container;

a plurality of light source feeding leads fixed to the housing;

a shaft for rotational mounting the coupling end of the cover on the housing;

a plurality of springs positioned on said shaft for urging said cover against said sleeve;

springs terminals extending out of the shaft and serving as fixed contacts with the battery source and also as a fixed and a movable contact with respect to said feeding leads.

11. The control unit for a light source in combination with a spray-defense container having an actuating button and a nozzle comprising:

a housing portion including a light source and an opening for the container nozzle a sleeve portion including an upper part for receiving said housing and a lower part for association with the container;

a cover extending over the actuating button, said cover having a coupling portion and a free portion with an internal compartment for supporting a battery source;

a hinge for rotationally mounting said cover at its coupling portion on said housing to enable said cover to rotate from its closed position in a plane substantially perpendicular to a longitudinal axis of the container to its opened position enabling a free access to the actuating button;

a circuit for electrically connecting the battery source to the light source;

a switch coupled to said housing and to said cover, said switch for closing said circuit in an opened position of said cover, and for opening said circuit in a closed position of a cover.

* * * * *